United States Patent [19]

Mandigo et al.

[11] 3,966,506

[45] June 29, 1976

[54] ALUMINUM ALLOY SHEET AND PROCESS THEREFOR

[75] Inventors: Frank N. Mandigo, North Branford; Philip R. Sperry, North Haven, both of Conn.

[73] Assignee: Swiss Aluminium Ltd., Chippis, Switzerland

[22] Filed: May 21, 1975

[21] Appl. No.: 579,423

[52] U.S. Cl. ..... 148/11.5 A; 148/32

[51] Int. Cl.[2] ..... C22F 1/04

[58] Field of Search ..... 148/11.5 A, 32, 34

[56] References Cited

UNITED STATES PATENTS

| | | | |
|---|---|---|---|
| 2,245,166 | 6/1941 | Stroup | 148/11.5 A |
| 3,359,085 | 12/1967 | Anderson | 148/32 |
| 3,490,955 | 1/1970 | Winter et al. | 148/11.5 A |
| 3,498,849 | 3/1970 | Munday et al. | 148/11.5 A |

*Primary Examiner*—W. Stallard

*Attorney, Agent, or Firm*—Robert H. Bachman; David A. Jackson

[57] ABSTRACT

Wrought aluminum alloy sheet products, displaying good ductility and resistance to grain coarsening when subjected to elevated temperatures as in brazing operations, are prepared by a process in which there is a final cold reduction of at least 50% and a subsequent partial annealing treatment sufficient to effect the recrystallization of 50 to 99% by volume of the metal. The resulting sheet products including composites have a substantially uniform grain structure characterized by the presence of mostly recrystallized grains, by uniformly distributed unrecrystallized grain fragments, and by the absence of coarse grains.

15 Claims, 4 Drawing Figures

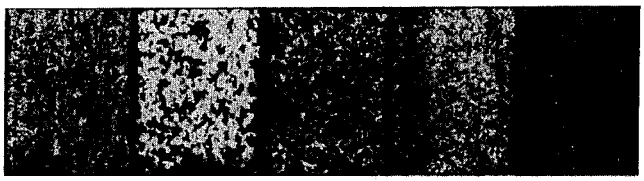
FIG. 1A
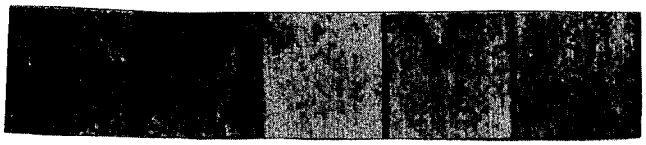
0 5 10 15 20
% COLD REDUCTION
FIG. 1B
FIG. 2A
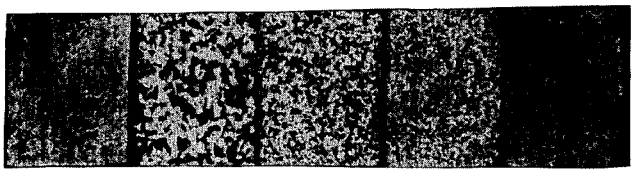
FIG. 2B
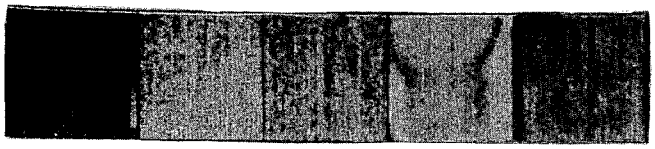
0 5 10 15 20
% COLD REDUCTION

ALUMINUM ALLOY SHEET AND PROCESS THEREFOR

BACKGROUND OF THE INVENTION

There has been a need for many years for low cost metal sheet which is characterized by adequate ductility and other desirable physical properties, such that the metal sheet is well adapted to undergo a preliminary forming operation and then a subsequent step of heating to an elevated temperature, such as in brazing, welding, or ceramic and/or resin coating operation. As the heating step occurs at a temperature at which recrystallization of the metal tends to occur rapidly, it is desirable to prevent the coarsening of grain structure during the recrystallization, which would otherwise reduce the strength properties of the article during the process of fabrication. In brazing operations, undue coarsening of the grains is also usually accompanied by the penetration of the molten brazing alloy between the boundaries of the enlarged grains, which can proceed to the extent of perforating the sheet.

Thus, when articles are formed of aluminum alloy sheets having a cladding of aluminum brazing alloy, the assembly of shaped parts is subjected to a temperature above the melting point of the cladding and below the melting point of the core metal. Any substantial coarsening of the metal grains that is brought about through recrystallization of the core alloy at the elevated temperature necessary to effect the brazing then tends to encourage penetration of the molten brazing alloy through the core and cause weakening and ultimate failure of the assembly.

It therefore became highly desirable to provide a clad aluminum brazing sheet so constituted as to prevent or minimize such deleterious grain coarsening on being subjected to a brazing cycle. Generally, it was desirable to provide a procedure for the preparation of aluminum alloy sheet which would impart resistance therein, or remove or minimize an apparently inherent susceptibility thereof, to substantial grain coarsening on recrystallization when subjected to an elevated temperature treatment.

It has therefore been a principal object of this invention to provide novel sheet of wrought aluminum alloy so constituted and structured as to display substantial resistance to grain coarsening at elevated temperatures.

A further object has been to provide a composite aluminum alloy sheet displaying adequate ductility to facilitate its formability together with substantial resistance to grain coarsening when subjected to a brazing operation.

Another objective of the invention has been the provision of a sequence of processing steps adequate to impart to an aluminum alloy sheet physical characteristics enabling ready formability combined with resistance to grain coarsening during a treatment for the bonding thereof at elevated temperatures.

Further objects and advantages of the present invention will appear from the following description.

SUMMARY OF THE INVENTION

The foregoing objects have been found to be advantageously attained in accordance with this invention.

The present invention provides a novel wrought aluminum alloy sheet, constituted and structured as set forth in the following description, so as to present physical characteristics including ductility which facilitate the shaping thereof to the desired form and at the same time the brazing thereof at an elevated temperature thereby to produce a firm and tightly bonded assembly without any substantial grain coarsening.

Such desired properties and characteristics have been obtained in accordance with the invention by the provision of process steps which comprise a cold working of aluminum alloy sheet to reduce its cross-sectional area by at least 50% and then a partial annealing treatment, to effect significant recovery and 50 to 99% recrystallization, but with the treatment controlled to avoid a full recrystallization. Thereby, the treated sheet has a ductility, which may be substantially equal to the ductility of a fully annealed, fully recrystallized sheet, well adapted to facilitate the shaping to the form desired in the completed article. At the same time, the retention of unrecrystallized grain fragments dispersed among the recrystallized grains in the metal sheet prevent or minimize to a significant extent the otherwise inherent tendency toward deleterious gran coarsening when the shaped sheet is heated to an elevated temperature, as in a brazing treatment.

BRIEF DESCRIPTION OF THE DRAWINGS

FIG. 1A is a photographic showing of the granular structure of a series of etched aluminum alloy samples, about an inch in width, after the samples had been fully annealed, cold reduced as indicated, and then heated through a brazing cycle.

FIG. 1B is a similar series of the same alloy wherein the initial treatment was limited to a partial anneal in the range of 50 to 99% by volume recrystallization.

FIGS. 2A and 2B similarly show like series using a different aluminum alloy.

DETAILED DESCRIPTION

In accordance with this invention, aluminum alloy sheets are prepared by a novel combination of processing treatments to result in a new structure, characterized by adequate ductility for shaping the sheet to the desired form and dimensions and at the same time, the requisite resistance to grain coarsening on being subjected to an elevated treating temperature at which recrystallization occurs.

Such combined properties have been made possible by this invention in providing that the processing comprises the cold working of the aluminum alloy sheet to accomplish a reduction of cross-sectional area by at least 50% and that such cold reduction step be followed by a partial anneal at about 500° to 700°F. for a sufficient period of time to accomplish significant recovery and recrystallization, but without complete recrystallization, the effective range being 50 to 99% by volume recrystallization.

The desired combination of ductility and resistance to grain coarsening is not consistently attainable when the initial cold reduction is substantially less than 50% or if the subsequent annealing treatment results in an extent of recrystallization that is substantially less than 50% or in excess of 99% by volume. A proper partial anneal within the effective range of 50 to 99% by volume is readily recognizable through the microscopic evaluation of etched metal samples, whereby recrystallized grains are readily differentiated from grains or grain fragments which indicate cold work or residual strain, generally in accordance with methods as described in Transactions of the American Society for Metals, Vol. 50, p.589–610 (1958). The extent of recrystallization may also be determined by comparison of tensile properties of the partially annealed metal following the initial cold working step with the values shown in the annealing curve for the same initially cold worked alloy.

After proper processing as above defined, the aluminum alloy sheet has strength and ductility properties approaching or closely similar to those of the fully annealed metal, and at the same time, displays strong or complete resistance to grain coarsening, even after being cold worked following the partial anneal, on subsequent exposure to elevated temperatures, as in a brazing cycle. Such cold work, to an extent up to about 20% reduction, is in a range usually encountered in shaping operations before brazing, and invariably causes deleterious grain coarsening on brazing, when applied to fully annealed metal.

The effectiveness of the above procedure has been confirmed by comparative tests described in the following illustrative examples. The aluminum base alloys tested were of the 3003 type or modifications thereof, and had the following compositions, the balance being essentially aluminum in each case:

ALLOYS

| Element | (1) | (2) | (3) | (4) |
|---|---|---|---|---|
| Si | 0.215 | 0.20 | 0.20 | 0.25 |
| Mn | 1.00 | 1.08 | 1.07 | 1.02 |
| Fe | 0.60 | 0.59 | 0.59 | 0.72 |
| Cu | 0.16 | 0.15 | 0.14 | 0.22 |
| Ti | 0.008 | 0.010 | 0.010 | 0.015 |
| V | 0.01 | 0.033 | 0.110 | — |
| Cr | — | — | — | 0.23 |
| Zr | — | — | — | 0.20 |

EXAMPLE I

Alloy (1) was melted and cast to ingot form by conventional procedure and homogenized by heating at the rate of 50°F./hr. from 600°0 to 1125°F., held at 1125°F. for 8 hours, cooled at 50°F./hr. to 1025°F., and then air-cooled to room temperature. After being scalped to 2.3 inch gage, the sheet was heated to 900°F. for an hour. The sheet ws hot rolled at 850°F. to 0.16 inch gage, and air-cooled. The sheet was cold-rolled to 0.060 inch gage and given a full anneal by heating from 300° to 660°F. at a rate of 25°F/hr., holding at 660°F. for 2.5 hours, cooling to 400°F. at a rate of 25°F./hr. and air-cooling to room temperature. After cold-rolling to 0.020 inch gage, the above full anneal was repeated.

Samples of the annealed 0.020 inch gage sheet were given deformation treatments to various extents by cold rolling 0, 5, 10, 15 and 20% cold reduction, and were then subjected to a brazing cycle, by placing the samples into a furnace maintained at 1100°F. for 18 minutes, the time at temperature being 8 to 10 minutes. Etched portions of each sample, one inch in width, were prepared and photographed, and are shown in FIG. 1A.

It is evident that marked grain coarsening occurred in the cold-worked samples after being subjected to the brazing cycle, particularly in the 5% and 10% cold reduction samples.

Comparison samples were prepared in accordance with the invention identically to the above through the step of cold-rolling to 0.020 inch gage. These samples, however, were then given a partial anneal by maintaining at 525°F. for 2.5 hours, using 50°F./hr. heating and cooling rates. Etched samples were prepared as above following the brazing cycle treatment, and are shown in FIG. 1B.

FIG. 1B clearly shows that no substantial grain coarsening has occurred in these samples, prepared in acordance with the invention.

EXAMPLE II

The above direct comparison was repeated on alloy (2) using the same treating steps as in the previous example. As shown in FIGS. 2A and 2B, the same beneficial effects of the present invention are evident.

EXAMPLE III

The above comparison was repeated on alloy (3) using the same treating schedule as in the above Examples, and similar results were obtained.

EXAMPLE IV

Comparison of alloy (4) was carried out as in the above examples, but with some variation from the treating schedule, as follows: the initial homogenization at 1125°F. was extended to 24 hours at temperature; the sheets were hot rolled to 0.125 inch gage starting at 800°F. and finishing at 750°F; then, cold rolling was carried out to 0.063 inch gage, the sheets were then fully annealed at 750°F. for 2.5 hours using 50°F./hr. heating and cooling rates; and, after cold rolling to 0.20 inch gage, the metal was again fully annealed as above.

Samples of the above sheet having 0, 5, 10, 15 and 20% cold reduction were subjected to the brazing cycle. Sample pieces of each were etched; grain coarsening occurred in all worked samples, and the series was closely similar in appearance to that shown in FIG. 1A.

Two series of samples were given a partial anneal in accordance with the invention following the cold-rolling to 0.020 inch gage; these comprised a 2.5 hour partial anneal at 600°F. for the first series and at 650°F. for the second. These were cold rolled 0 to 20% and subjected to the brazing cycle. After etching, both series displayed the same uniformity of grain size throughout the range as in the preceding examples in accordance with the invention, as shown in FIGS. 1B and 2B; in the second series, the individual grains appeared somewhat larger than in the first, but quite uniform over each surface and throughout the series.

Sections of these samples, as well as of those in accordance with the invention in the other specific examples, consistently indicated under metallographic examination that the surface granular structures illustrated in the drawings are typical of the microstructure throughout each specimen.

EXAMPLE V

Alloy (4) was treated as in the preceding example, except that homogenization was carried out at 1000°F. for 16 hours, and the hot rolling to 0.5 inch gage occurred in a number of passes after heating to 900°F. and holding here for at least an hour, with reheating after each pass, and then rolling to 0.125 inch gage at 600°F.

As in the other examples, comparison was made of samples given a full final anneal (in this case, for 2.5 hours at 700°F.) as contrasted with samples given a final partial anneal in accordance with the invention (in this case, for 2.5 hours at 650°F.). The two series were cold rolled in the range of 0 to 20% and each sample was subjected to the brazing cycle. As in the other example, significant grain coarsening occurred in the series where the cold reduction was applied following a full anneal, particularly in the 10, 15 and 20% cold reduction samples. However, the samples prepared according to the invention showed no substantial grain coarsening, being quite similar in appearance to FIGS. 1B and 2B.

Tensile properties of alloys, given a final partial anneal in accordance with the invention as described in some of the above examples, are listed in Table I.

TABLE I

| Example No. | Anneal Temp. (°F) | Anneal time (hrs.) | 0.2% Yield Strength (ksi) | Ultimate Tensile Strength (ksi) | % Elongation in 2 inches |
|---|---|---|---|---|---|
| I | 525 | 2.5 | 6.7 | 16.5 | 26.5 |
| II | 525 | 2.5 | 12.0 | 19.0 | 18.0 |
| IV | 600 | 2.5 | 14.8 | 21.0 | 12.5 |
| | 650 | 2.5 | 6.1 | 16.4 | 25.0 |
| V | 650 | 2.5 | 9.0 | 18.4 | 19.0 |

The above properties of the incompletely recrystallized alloys in general approach those obtained after a full final anneal wherein the alloys have been fully recrystallized. Such comparison provides a means for estimating the extent to which the partial recrystallization has been effected.

The resistance to exaggerated grain coarsening is probably imparted to the metal because of the effects of cold work, represented by residual strained grain fragments dispersed throughout the field of recrystallized grains following the 50 to 99% by volume partial anneal. Thus, potential recrystallization nuclei are presumed to be present throughout the metal in its partially annealed and incompletely recrystallized state, so as to prevent the localized growth of unduly coarse grains after subsequent cold working and heating to an elevated temperature for a brazing or other bonding operation.

From the above, it will be evident that the objectives of the invention have been attained in the provision of a basic procedure resulting in a wrought aluminum alloy sheet product having an incompletely annealed structure, which combines excellent formability and an unusual resistance to exaggerated grain coarsening. Such wrought aluminum alloy sheets, either in unitary or composite form, are thus well adapted for conversion to a finished article by fabrication methods involving shaping each sheet to final form and subjecting to treatment at elevated temperature, as in brazing or other bonding operations.

Furthermore, the range of physical properties listed in Table I, indicates the great flexibility available to meet requirements by the use of procedures in accordance with the invention. Such flexibility may be readily attained by selection of the best suited alloy or alloys for the particular purpose, by the adoption of the most appropriate conditions for the homogenization treatment, for the extent of cold reduction, and for the optimum time and temperature conditions applied at the final partial anneal so as to result in treated metal having the desired volume fraction of uniformly distributed unrecrystallized grain fragments for securing the best results.

Advantages of the invention are particularly well illustrated by improved composite aluminum brazing sheets, which constitute a preferred embodiment in accordance with the invention. Such brazing sheets characterized by the novel structure of this invention are readily adapted for the manufacture of heat exchangers by shaping the component parts, assembly, and completion by a brazing treatment, for example, by heating at 1100°F. for about 10 minutes. Thus, the novel brazing sheets enable the overcoming of problems encountered with the use of prior composite sheets in the assembly of heat exchangers, such as were described in U.S. Pat. No. 3,584,682, with the brazing operation carried out in an inert atmosphere in accordance with U.S. Pat. No. 3,482,305, as well as in making brazed heat exchangers, generally shown in U.S. Pat. Nos. 3,859,058 and 3,872,921.

The composite brazing sheet prepared in accordance with the invention may comprise any of a variety of aluminum alloys as the base or core element, as typified by alloys designated by the Aluminum Association as Nos. 3003, 6951 and variations thereof, and the alloy compositions in the above specific examples. Thus, the base sheet may consist of an aluminum alloy containing up to several percent of an element or elements known to enhance a desired property or combination of properties or effects, such as to accomplish grain refinement or improve corrosion resistance or to provide increased strength. The aluminum alloys contemplated for the base sheet likewise include commercial forms of aluminum such as Alloy 1100, which may contain up to about 1% of elements often present as impurities such s Fe, Si, Cu, Ti and others. Preferably, the base sheet is one characterized by an initial melting point not lower than about 1150°F. so that it is adapted for withstanding brazing and other bonding operations at temperatures of 1125°F. or lower, at which the common aluminum brazing compositions are completely liquefied.

The brazing alloy cladding, bonded to one or both of the core surfaces as a layer having a thickness of 5 to 15% of the core thickness, may be comprised of an alloy such as X4005, 4045, 4047, 4145, 4343, and similar alloys, these being generally characterized by a content of 5 to 15% silicon and a melting point between about 975°F. and 1125°F., preferably having a melting range not over about 50°F. Additional constituents may be present, such as 0.01 to 5% copper or magnesium or 0.01 to 10% zinc.

The composite brazing sheet, having the core clad on one or both surfaces, may readily be made in accordance with known methods. For example, such composite sheet may be produced by the thorough cleaning and wire brushing of the surfaces intended to be bonded, bringing the surfaces together, and passing them between suitably spaced rotating rolls to effect the proper reduction in thickness to result in a metallurgically bonded composite.

Although the use of partially annealed core metal is not broadly new in the preparation of composite sheets, previous practice of this type of operation appears to have been limited to partially annealing within the recovery and initial recrystallization stages, that is, to partial annealing treatments accomplishing the recrystallization of considerably less than 50% by volume of the metal. Such a step was disclosed, for example, in U.S. Pat. No. 3,340,027. The present use of a far more extensive partial anneal, which may more aptly be termed a substantial though incomplete recrystallization step, is therefore to be considered a novel advance in the art, which has enabled the ready attainment of advantageous and surprising results.

In some brazing or other bonding operations, the assembly of parts may be accomplished with the use of brazing alloy in the form of metal powder or strips inserted at desired locations between portions of the base sheet intended to be joined. It will, therefore, be understood that for such use, base sheet free of cladding may be prepared in accordance with this invention, to impart thereto the desired resistance to harmful grain coarsening.

Thus, the process of this invention is advantageously applicable to the preparation of unitary wrought aluminum alloy sheet, particularly for such sheet intended for subsequent treatment at elevated temperatures for the bonding ot an adherent layer of synthetic resin, glass, or ceramic thereto. For the same basic reasons, problems similar to those with respect to brazing operations as detailed above, have been advantageously solved. Such unitary sheet may be of aluminum alloys as specified previously for the core of composite sheets, and particularly of aluminum alloys containing an element or elements imparting increased tensile properties which may be strengthened by appropriate heat treatment.

In the processing of such unitary wrought aluminum alloy sheet, the treatment may be similar to or identical with the preferred embodiments as described in the above specific examples.

It will be evident from the foregoing detailed description that the process and product of this invention have enabled the attainment of the specified objectives. It will also be understood that the achievement of the specified objectives is not limited to the preferred embodiments of the invention, which are deemed to be illustrative of its best modes of operation, but that all modifications within the spirit thereof are to be considered within the scope specified by the appended claims.

What is claimed is:

1. A wrought aluminum alloy sheet product wherein said alloy contains up to 2% by weight of at least one alloying element and up to 1% by weight of at least one additional element selected from the group consisting of iron, silicon, copper, magnesium and titanium, said sheet being characterized by a substantially uniform grain structure in which at least half the sheet volume consists of fully recrystallized grains and at least 1% of said volume consists of strained grain fragments substantially uniformly dispersed among the said recrystallized grains, whereby the said sheet product displays substantial ductility and high resistance to grain coarsening at elevated temperatures above the recrystallization point and below the melting point thereof.

2. A sheet in accordance with claim 1, wherein the said alloy contains 0.01 to 0.2% vanadium.

3. A sheet in accordance with claim 1, wherein the said alloy contains 0.2 to 1% silicon, 0.5 to 1% iron, and 1 to 2% manganese.

4. A sheet in accordance with claim 1, wherein the said alloy contains 0.2 to 0.7% zirconium and 0.1 to 0.35% chromium.

5. A sheet in accordance with claim 1, wherein the said alloy contains up to 1% of an element selected from the group consisting of iron, silicon, copper, magnesium and titanium.

6. A sheet in accordance with claim 1, wherein at least one surface thereof is metallurgically bonded to a cladding of aluminum alloy having 5 to 15% content of silicon and a melting point of 975° to 1125°F.

7. A process of imparting increased ductility and resistance to grain coarsening to an aluminum alloy sheet comprising subjecting said sheet to a step of cold reduction of at least 50% and then to a final partial annealing treatment at a temperature of 500° to 700°F., while limiting the treatment time to a period sufficient only to cause the full recrystallization of 50 to 99% by volume of said alloy and leaving at least 1% by volume of said alloy as strained unrecrystallized grain fragments substantially uniformly dispersed among the said recrystallized grains.

8. A process in accordance with claim 7, wherein the said alloy contains up to 2% by weight of at least one alloying element.

9. A process in accordance with claim 7, wherein the said alloy contains an element selected from the group consisting of iron, silicon, copper, magnesium and titanium.

10. A process in accordance with claim 7, wherein the said alloy contains 0.01 to 0.2% vanadium.

11. A process in accordance with claim 7, wherein the said alloy contains 0.2 to 1% silicon, 0.5 to 1% iron, and 1 to 2% manganese.

12. A process in accordance with claim 7, wherein the said alloy contains 0.2 to 0.7% zirzonium and 0.1 to 0.35% chromium.

13. A process in accordance with claim 7, wherein the said alloy contains up to 1% of an element selected from the group consisting of iron, silicon, copper, magnesium and titanium.

14. A process in accordance with claim 7, wherein the said partial annealing treatment is carried out for 2.5 hours at 525°F.

15. A process in accordance with claim 7, wherein the said partial annealing treatment is carried out for up to 2.5 hours at 600° to 650°F.

* * * * *

UNITED STATES PATENT AND TRADEMARK OFFICE

CERTIFICATE OF CORRECTION

PATENT NO. : 3,966,506

DATED : June 29, 1976

INVENTOR(S) : Frank N. Mandigo and Philip R. Sperry

It is certified that error appears in the above-identified patent and that said Letters Patent are hereby corrected as shown below:

In Column 1, line 11, after the word "in" insert ---a---;

In Column 1, line 45, after the word "provide" insert ---a---.

In Column 2, line 21, the word "gran" should read ---grain---.

In Column 3, line 40, "600°0" should read ---600°F.---;

In Column 3, line 44, the word "ws" should read ---was---.

In Column 4, line 59, the word "here" should read ---there---.

In Column 6, line 30, "s" should read ---as---.

In Column 8, line 41, "zirzonium" should read ---zirconium---.

Signed and Sealed this

Thirtieth Day of November 1976

[SEAL]

*Attest:*

RUTH C. MASON
*Attesting Officer*

C. MARSHALL DANN
*Commissioner of Patents and Trademarks*